US009222652B2

(12) United States Patent
Deurenberg et al.

(10) Patent No.: US 9,222,652 B2
(45) Date of Patent: Dec. 29, 2015

(54) LIGHTING MODULE AS A TOOL FOR CONNECTING/DISCONNECTING ANOTHER LIGHTING MODULE

(75) Inventors: Peter Hubertus Franciscus Deurenberg, 's Hertogenbosch (NL); Antonius Petrus Marinus Dingemans, Tilburg (NL); Martinus Petrus Creusen, Wijlre (NL); Merijn Keser, Eindhoven (NL); Mathew Lee Bembridge, Rotterdam (NL); Dick Joep Marco Janssen, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 367 days.

(21) Appl. No.: 13/810,825

(22) PCT Filed: Jul. 18, 2011

(86) PCT No.: PCT/IB2011/053186

§ 371 (c)(1),
(2), (4) Date: Jan. 17, 2013

(87) PCT Pub. No.: WO2012/011041

PCT Pub. Date: Jan. 26, 2012

(65) Prior Publication Data

US 2013/0120992 A1 May 16, 2013

(30) Foreign Application Priority Data

Jul. 21, 2010 (EP) ..... 10170230

(51) Int. Cl.
*H01R 33/00* (2006.01)
*F21V 19/04* (2006.01)

(Continued)

(52) U.S. Cl.
CPC . *F21V 19/04* (2013.01); *F21K 9/30* (2013.01); *F21V 15/01* (2013.01); *F21V 19/0005* (2013.01); *F21S 8/02* (2013.01); *F21V 29/74* (2015.01); *F21Y 2101/02* (2013.01)

(58) Field of Classification Search
CPC ..... F21V 23/06; F21V 19/04; F21V 17/04; F21V 21/08; F21V 17/06; F21V 19/00; F21V 19/0045
USPC ..... 362/640, 647
See application file for complete search history.

(56) References Cited

U.S. PATENT DOCUMENTS 4,006,653 A * 2/1977 Kuntzsch ..... 81/64
4,872,097 A 10/1989 Miller (Continued)

FOREIGN PATENT DOCUMENTS

JP 2009093926 A 4/2009
WO 2010146509 A1 12/2010

*Primary Examiner* — William Carter
(74) *Attorney, Agent, or Firm* — Yuliya Mathis

(57) ABSTRACT

A lighting module (1) having a connection end (2) for connection to a lamp holder (3), and a light output end (4) for outputting light, wherein the lighting module (1), at the light output end (4), is provided with a mechanical interface comprising first (6) and second (7) protrusions extending in a direction parallel with a longitudinal axis (13) of the lighting module and being configured to interact with corresponding protrusions (6',7') on an identical mechanical interface to transfer at least one of a rotational force and a pulling force to the lighting module (1), so that a device (1') provided with such an identical mechanical interface can be used as a tool for connecting/disconnecting the lighting module (1). An advantage is that it is possible to utilize one lighting module as a tool to connect/disconnect another lighting module from a lamp holder.

10 Claims, 4 Drawing Sheets

(51) Int. Cl.

| | |
|---|---|
| ***F21K 99/00*** | (2010.01) |
| ***F21V 15/01*** | (2006.01) |
| ***F21V 19/00*** | (2006.01) |
| *F21S 8/02* | (2006.01) |
| *F21Y 101/02* | (2006.01) |
| *F21V 29/74* | (2015.01) |

(56) References Cited

U.S. PATENT DOCUMENTS

| | | | | |
|---|---|---|---|---|
| 5,217,292 | A * | 6/1993 | Chalberg | 362/101 |
| 6,338,647 | B1 | 1/2002 | Fernandez et al. | |
| 2007/0249184 | A1 | 10/2007 | Hamada | |
| 2010/0061076 | A1 | 3/2010 | Mandy et al. | |

* cited by examiner

LIGHTING MODULE AS A TOOL FOR CONNECTING/DISCONNECTING ANOTHER LIGHTING MODULE

FIELD OF THE INVENTION

The present invention relates to a lighting module connectable to a lamp holder. The present invention also relates to a luminaire comprising such a lighting module.

BACKGROUND OF THE INVENTION

Many lighting systems, such as luminaires, utilize replaceable lighting modules to extend the life time of the system and/or allow for a change in lighting characteristics. The luminaire typically includes a lamp holder to which the lighting module is connectable. The connection between the lighting module and the lamp holder can, for example, be implemented as plug-in coupling, a screw coupling, or as a bayonet coupling where a connection end of the lighting module is introduced into the lamp holder along a direction parallel with the longitudinal axis of the lighting module, and then twisted until the two coupling parts of the bayonet coupling are interlocked. However, quite a bit of space is required around the lighting module to be able to connect and disconnect the lighting module to the lamp holder with ones hand. For example, in a typical luminaire minimum 15 mm, but preferably 25 mm in the radial direction around the lighting module is required to be able to grab the lighting modules by ones fingers. The reflector diameter will grow with at least twice this value, which limits design aspects of the luminaire. Also bringing fingers inside the reflectors risks the reflector becoming dirty, reducing its efficiency and its looks.

U.S. Pat. No. 4,006,653 discloses a tool for inserting and extracting a lamp bulb from relatively inaccessible areas. However, as such a tool can be misplaced, lost and needs to be supplied in addition to the lighting module, it adds costs to the system and inconvenience to the user. Thus, there is a need for a convenient and cost-efficient solution that allows a lighting module to be connected/disconnected to a lamp holder in a relatively inaccessible area.

SUMMARY OF THE INVENTION

It is an object of the present invention to overcome this problem, and to provide a convenient and cost-efficient solution that allows a lighting module to be connected/disconnected to a lamp holder in a relatively inaccessible area.

According to an aspect of the invention, this and other objects are achieved by a lighting module having a connection end for connection to a lamp holder, and a light output end for outputting light, wherein the lighting module, at the light output end, is provided with a mechanical interface comprising first and second protrusions extending in a direction parallel with a longitudinal axis of the lighting module and being configured to interact with corresponding protrusions on an identical mechanical interface to transfer at least one of a rotational force and a pulling force to the lighting module, so that a device provided with such an identical mechanical interface can be used as a tool for connecting/disconnecting the lighting module.

The present invention is based on the understanding that by providing a lighting module which has a mechanical interface with first and second protrusions configured to interact with corresponding protrusions on an identical mechanical interface to transfer a rotational force or a pulling force, it is possible to utilize one lighting module as a tool to connect/disconnect another lighting module from a lamp holder. Thus, when a person is about to replace an old lighting module with a new lighting module, the new lighting module can be used as a tool to disconnect the old lighting module from the lamp holder. The old lighting module can then be utilized as a tool to connect the new lighting module to the lamp holder. This means that no separate tool is required. Moreover, as the lighting module which is connected to the lamp holder is not grabbed by hand, the space around the lighting module can be reduced allowing more freedom in designing the luminaire.

The first and second protrusions may be configured to be engaged with corresponding protrusions on the identical mechanical interface after a relative rotation between the mechanical interfaces about the longitudinal axis of the lighting module.

Furthermore, the first and second protrusions may be configured such that relative movement between the mechanical interfaces in a direction parallel with the longitudinal axis of the lighting module is prevented when the first and second protrusions are engaged with the corresponding protrusions on the identical mechanical interface. An advantage is that as the lighting module is connected/disconnected to the lamp holder by a twisting movement, the two interacting mechanical interfaces will remain engaged, even if lighting modules are not pushed towards each other. Another advantage is that a pulling force (parallel with a longitudinal axis of the lighting module) can be transferred between the mechanical interfaces so that one lighting module can be used to pull out another lighting module from the lamp holder. This may be convenient, for example, if a plug-in socket is used.

The first and second protrusions may be tapered in such a way that an intermediate recess formed between the first and second protrusions has a neck that prevents relative movement between the mechanical interfaces in a direction parallel with the longitudinal axis of the lighting module when the first and second protrusions are engaged with the corresponding protrusions on the identical mechanical interface.

The necks of the intermediate recesses may preferably be sufficiently wide to allow corresponding protrusions on the identical mechanical interface to pass through the necks in a direction parallel with the longitudinal axis of the lighting module. Thus, the mechanical interfaces may be interlocked after the mechanical interfaces have been rotated relative each other to an end position, but detachable in an intermediate position.

The protrusions may preferably be arranged along a periphery of the lighting module. An advantage is that the protrusions interference with the light output window can be minimized.

According to an embodiment, the lighting module may be cylindrical, and the protrusions may be an extension of a wall of the cylindrical lighting module. Preferably, the lighting module may be circular cylindrical, but the cylinder may also have other shapes such as e.g. a cylinder with a rectangular or hexagonal base.

Furthermore, the lighting module according to the present invention may advantageously be included in a set of lighting modules comprising a plurality of lighting modules according to the present invention, wherein a first lighting module in the set of lighting modules can be used as a tool for connecting/disconnecting a second lighting module in the set of lighting modules.

Furthermore, the lighting module according to the present invention may advantageously be included in a lighting system, such as a luminaire, further comprising a lamp holder for receiving the lighting module.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

DETAILED DESCRIPTION

Figure 1:
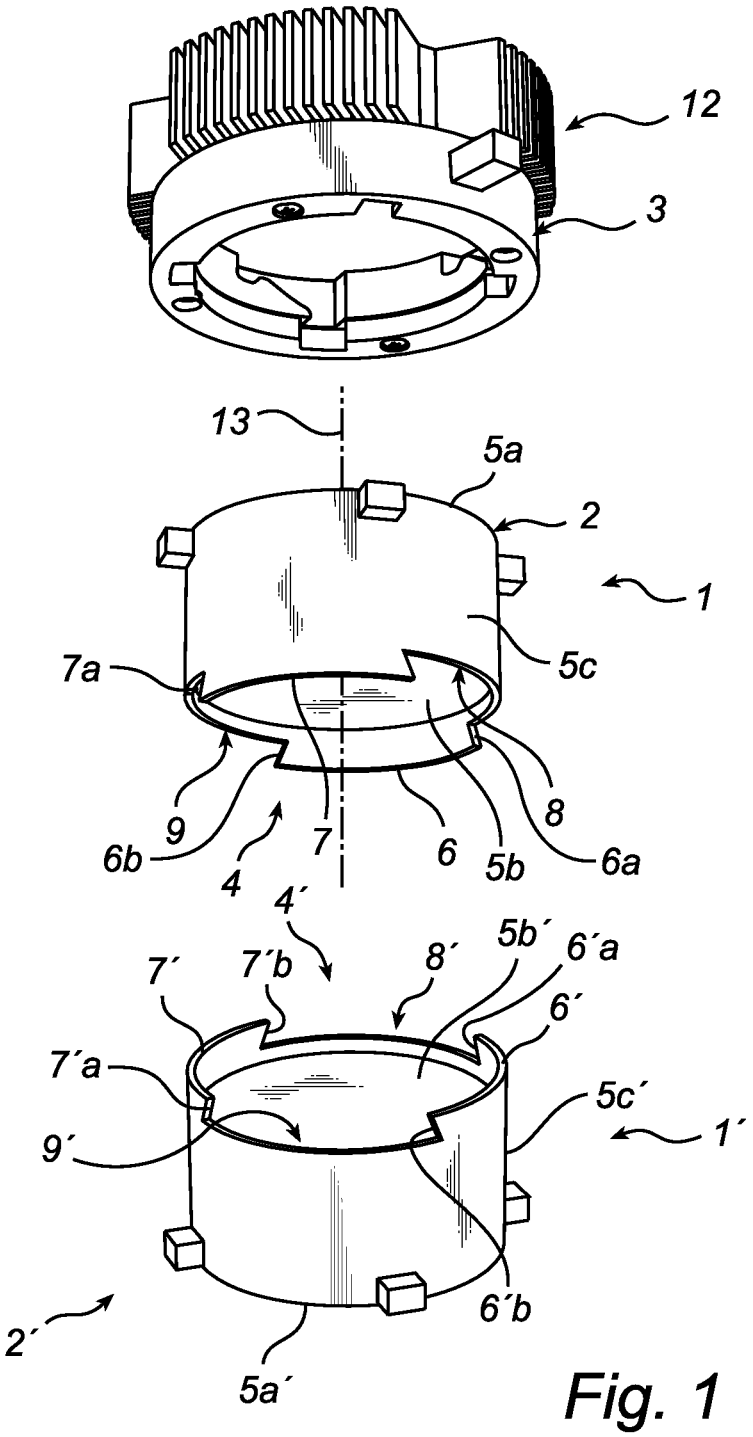
FIG. 1 is a perspective view schematically illustrating a lighting module according to an embodiment of the invention.

FIG. 1 schematically illustrates a lighting module 1 having a connection end 2 for connection to a lamp holder 3, and a light output end 4 for outputting light. The lamp holder 3 may optionally be attached to a heat sink 12. The lighting module 1 includes a housing accommodating a light source (not shown), such as one or more light emitting diodes (LEDs). The housing is here a circular cylindrical housing comprising a bottom surface 5*a*, a top surface 5*b* and a wall 5*c* (i.e. the envelope surface of the cylinder) extending between the bottom surface 5*a* and the top surface 5*b*. In the illustrated embodiment, the top surface 5*b* includes a light output window configured such that the light emitted by the light source can escape from the lighting module. The light output window may, for example, be a disc or lens made of glass, plastic or other suitable optically transparent material.

At the light output end 4, the lighting module 1 is provided with a mechanical interface comprising first 6 and second 7 protrusions extending in a direction parallel with a longitudinal axis 13 of the lighting module. Here, the protrusions 6, 7 are formed by designing the wall 5*c* of the housing in such a way that it locally extends beyond the top surface 5*b*. Thus, the protrusions 6,7 can be formed as an integral part of the housing wall 5*c* to create a robust construction. For example, the housing wall 5*c* with its protrusions 6,7 can be injection moulded in a single piece.

The height of the protrusions (i.e. the extension in the direction parallel with the longitudinal axis 13 of the lighting module) may vary but is preferably less than 10 mm, and more preferably less than 7 mm and most preferably less than 4 mm. An advantage with low protrusions is that they block less light. Here the protrusions have a height of 3 mm.

Furthermore, the width of the protrusions may vary. Here each protrusion covers slightly less than 90° of the total peripheral, but the width of each protrusion may be substantially smaller. For example, it would be possible with an interface where each protrusion covers about 10° of the total peripheral, or even less.

Figure 2A:
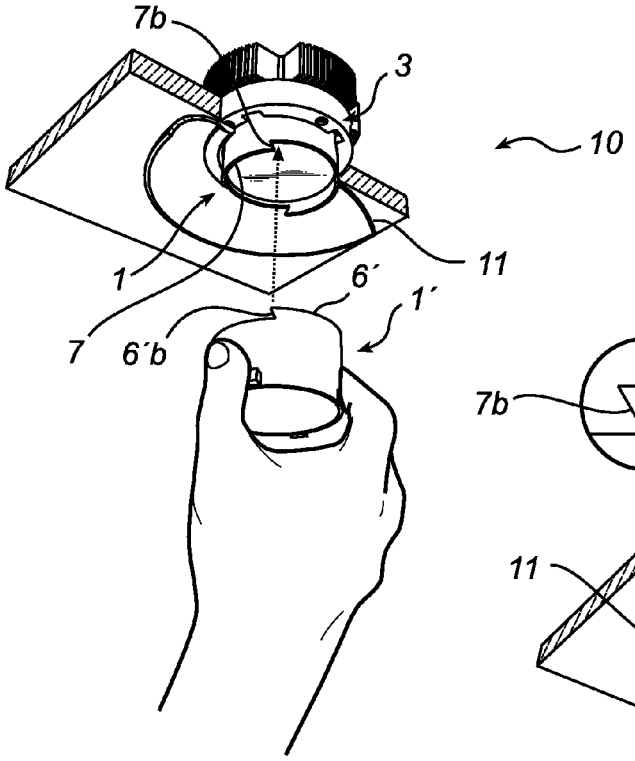
FIGS. 2*a-e* schematically illustrates replacement of a lighting module installed in a luminaire.
Figure 2B:
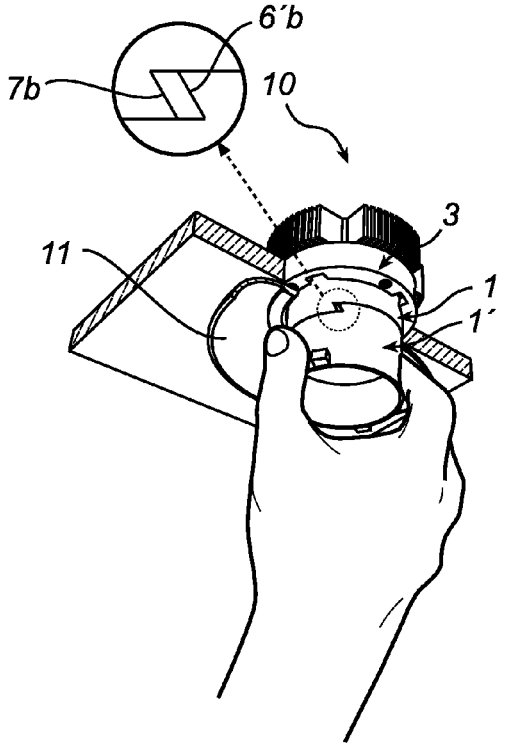
Figure 2C:
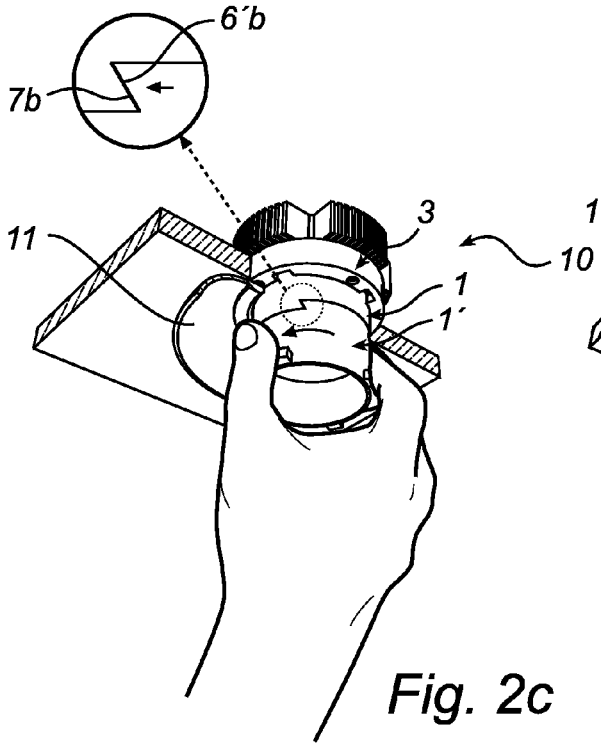
Figure 2D:
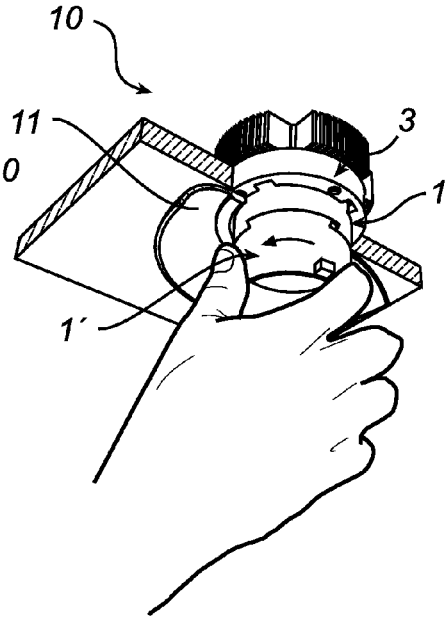
Figure 2E:
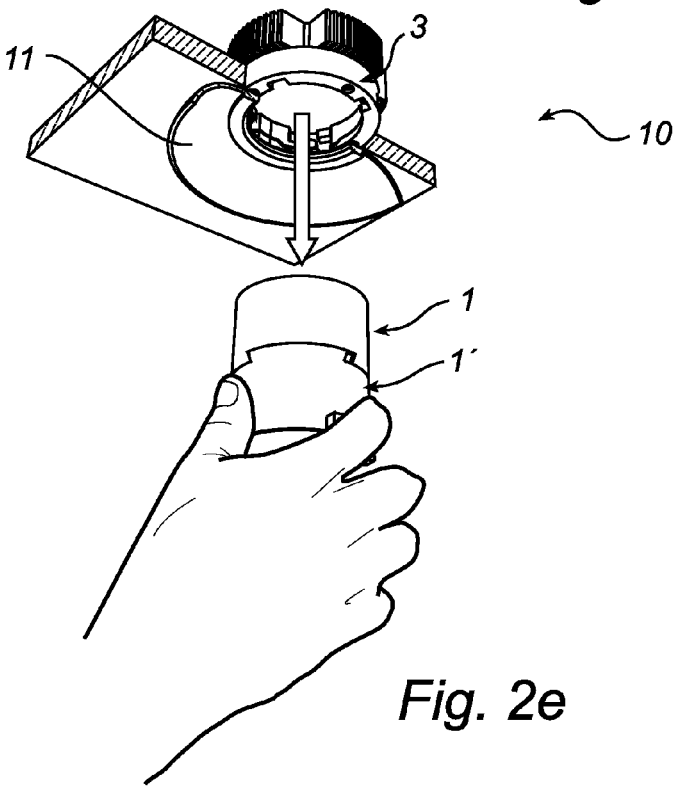
Figure 3:
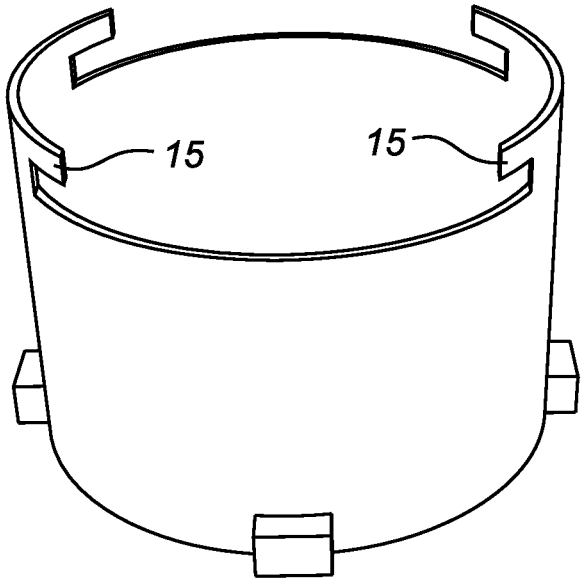
FIG. 3 is a perspective view schematically illustrating an alternative embodiment of the lighting module.

The first 6 and second 7 protrusions are preferably tapered in such a way that each of the intermediate recesses 8,9 formed between the first 6 and second 7 protrusions has a neck (i.e. a relatively narrow section). The necks are sufficiently wide to allow corresponding protrusions 6',7' on an identical mechanical interface on a second lighting module 1' to pass through the necks in a direction parallel with the longitudinal axis 13 of the lighting module. However, after a relative rotation between the lighting modules 1,1' about the longitudinal axis 13 of the lighting module, each of the protrusion 6,7 will have a lateral side 6*a-b*,7*a-b* engaged with a lateral side 6'*a-b*,7'*a-b* of one of the corresponding protrusions 6',7' on the identical mechanical interface of the second lighting module 1' so as to prevent relative movement between the mechanical interfaces in a direction parallel with the longitudinal axis 13 of the lighting module. The lateral sides 6*a-b*,7*a-b* of the protrusions 6,7, here forms a wedge, but may also have other shapes. For example, as illustrated in FIG. 3, each lateral side of the protrusions may have a projection 15 that can prevent relative movement between the mechanical interfaces in a direction parallel with the longitudinal axis of the lighting module. The mechanical interface illustrated in FIG. 3 may be preferable when a substantial pulling force (parallel with a longitudinal axis of the lighting module) should be transferred between the mechanical interfaces, such as when one lighting module is used to pull out another lighting module out from a plug-in socket. FIGS. 2*a-e* schematically illustrates removal of a lighting module 1 installed in a luminaire 10. The illustrated luminaire 10 includes a lamp holder 3 for receiving the connection end of the lighting module 1, and a reflector 11 for reflecting light output by the lighting module 1. It is noted that the connection between the lamp holder and the lighting module may be achieved in a variety of ways. For example, the connection may be a plug-in coupling, a screw coupling, or a bayonet-coupling. However, here it is assumed that the connection is achieved by a bayonet coupling.

As a person is about to replace the old lighting module 1 (i.e. the currently installed lighting module), with another lighting module 1' (also referred to as new lighting module) he may utilize the new lighting module 1' to disconnect the old lighting module 1 from the lamp holder. To do this, the person grabs the new lighting module 1', and reaches into the reflector 11 to engage the mechanical interface of the new lighting module 1' with the mechanical interface of the old lighting module 1. This engagement is achieved by introducing the protrusions 6',7' of the new lighting module 1' into the intermediate recesses 8,9 in the old lighting module, and then rotating the new lighting module 1' (here anti-clockwise). This will result in a relative rotation between the mechanical interfaces about the longitudinal axis 13 of the lighting module until an end position is reached where a lateral side of each of the protrusions 6',7' of the new lighting module abuts a lateral side of the protrusions 6,7, of the old lighting module, as illustrated in FIG. 2*c*. For the lighting modules illustrated in FIG. 1 and FIG. 2, this means that the lateral side 6'*b* will abut lateral side 7*b*, and lateral side 7'*b* will abut lateral side 6*b* when the new lighting module 1' is rotated anti-clockwise. As the person twists the new lighting 1' in his hand further, the rotational force will be transferred from the new lighting module 1' to the old lighting module 1 via the protrusions, so that the old lighting module 1 is rotated in relation to the lamp holder 3 and disconnected from the bayonet coupling. It is noted that the wedge-shaped lateral sides 6'*a-b*,7'*a-b* of the protrusions forces the mechanical interfaces together and strengthens the grip between the mechanical interfaces during the twist. Thus, it is not necessary to push the lighting modules towards each other during rotation.

Similarly, the person can connect the new lighting module 1' to the lamp holder 3 by grabbing the old lighting module 1. Placing the new lighting module 1' on top of the old lighting module 1 in such a way that the protrusions 6,7 of the old lighting module are inserted in the intermediate recesses 8',9' in the new lighting module 1' so as to engage the mechanical interfaces. Then, holding the old lighting module 1 in his hand, introducing the connection end 2' of the new lighting module 1' in the lamp holder 3, and twisting the old lighting module 1 clockwise, whereby the rotational force will be transferred from the old lighting module 1 to the new lighting module 1' via the protrusions, so that the new lighting module 1' is rotated in relation to the lamp holder 3 and connected to the bayonet coupling.

The person skilled in the art realizes that the present invention by no means is limited to the preferred embodiments described above. On the contrary, many modifications and variations are possible within the scope of the appended claims. For example, the mechanical interface of each lighting module may have more than two protrusions. Principally, there is no limit in this number, although at some point, the protrusions will become too small to be useful.

The invention claimed is:

1. A lighting module comprising:

a connection end for connection to a lamp holder, and a light output end for outputting light, wherein said light output end comprises a mechanical interface comprising first and second protrusions extending in a direction parallel with a longitudinal axis of the lighting module, wherein said first and second protrusions are configured to engage with corresponding protrusions on a mechanical interface of another identical lighting module and configured to transfer at least one of a rotational and a pulling force to said lighting module, such that said another identical lighting module is operable to connect and/or disconnect said lighting module.

2. The lighting module according to claim 1, wherein said first and second protrusions are configured to be engaged with the corresponding protrusions on the identical mechanical interface after a relative rotation between said mechanical interfaces about the longitudinal axis of the lighting module.

3. The lighting module according to claim 1, wherein said first and second protrusions are configured such that relative movement between the mechanical interfaces in a direction parallel with the longitudinal axis of the lighting module is prevented when said first and second protrusions are engaged with the corresponding protrusions on the identical mechanical interface.

4. The lighting module according to claim 1, wherein said first and second protrusions are tapered in such a way that an intermediate recess formed between said first and second protrusions has a neck that prevents relative movement between the mechanical interfaces in a direction parallel with the longitudinal axis of the lighting module when said first and second protrusions are engaged with the corresponding protrusions on the identical mechanical interface.

5. The lighting module according to claim 4, wherein the necks of the intermediate recesses are sufficiently wide to allow corresponding protrusions on the identical mechanical interface to pass through the necks in a direction parallel with the longitudinal axis of the lighting module.

6. The lighting module according to claim 1, wherein said protrusions are arranged along a periphery of said lighting module.

7. The lighting module according to claim 1, wherein said lighting module is cylindrical, and said protrusions are an extension of a wall of said cylindrical lighting module.

8. The lighting module according to claim 7, wherein said lighting module is circular cylindrical.

9. A set of lighting modules comprising a plurality of lighting modules according to claim 1, wherein a first lighting module in said set of lighting modules can be used as a tool for connecting/disconnecting a second lighting module in said set of lighting modules.

10. A luminaire comprising:

a lighting module according to claim 1; and a lamp holder for receiving said lighting module.

* * * * *